United States Patent [19]

Ogura et al.

[11] Patent Number: 4,497,693

[45] Date of Patent: Feb. 5, 1985

[54] METHOD FOR PLATING AN ARTICLE AND THE APPARATUS THEREFOR

[75] Inventors: Ken Ogura, Okazaki; Nobuhiko Yamada, Hekinan; Hiroshi Ohmi, Anjo, all of Japan

[73] Assignee: Nippondenso Co., Ltd., Kariya, Japan

[21] Appl. No.: 592,087

[22] Filed: Mar. 22, 1984

[30] Foreign Application Priority Data

Apr. 11, 1983 [JP] Japan ..... 58-62318

[51] Int. Cl.[3] ..... C25D 5/02; C25D 17/06

[52] U.S. Cl. ..... 204/15; 204/212; 204/297 W; 204/DIG. 7

[58] Field of Search ..... 204/15, DIG. 7, 212, 204/237, 286, 297 W

[56] References Cited

U.S. PATENT DOCUMENTS

| | | | |
|---|---|---|---|
| 4,032,414 | 6/1977 | Helder | 204/15 |
| 4,280,882 | 7/1981 | Hovey | 204/15 |
| 4,323,433 | 4/1982 | Toch | 204/DIG. 7 |
| 4,421,627 | 12/1983 | LeBaron | 204/297 W |

*Primary Examiner*—Thomas Tufariello

*Attorney, Agent, or Firm*—Cushman, Darby & Cushman

[57] ABSTRACT

A method and apparatus for plating an article having a portion that needs no plating at a high speed including as main components a chuck for chucking the article at the portion above stated and a shield cover for enclosing the chuck, maintaining a space therebetween. The space indicated above works to prevent an electrolyte from raising its level, thus keeping said portion out of said the electrolyte.

5 Claims, 7 Drawing Figures

METHOD FOR PLATING AN ARTICLE AND THE APPARATUS THEREFOR

BACKGROUND OF THE INVENTION

The present invention relates to a method to plate an article which has a portion to be nonplated at a high speed, the remainder being plated completely. The present invention also relates to an apparatus which is able to plate an article having a portion of nonplating at a high speed. Particularly the present invention is useful when applied to a housing with an earth electrode for spark plugs for internal combustion engines.

Conventionally, a spark plug housing made of ferrous metal with an earth electrode made of Ni-Cr (Nickel-Chromium) alloy has been plated in a barrel which holds a lot of housings, or by hanging a lot of housings on a plating hanger, which is the same as the conventional method for other general articles.

However in the method above, the plating is made on such a portion that needs no plating from the beginning or the portion that is difficult to plate because of the base metal of Ni-Cr alloy, i.e. the earth electrode. Therefore when the earth electrode is bent to make the final product, the plating is sometimes peeled off, or a similar problem occurs when the spark plug is mounted to the engine and subjected to severe heat cycle to cause sometimes a bridge between the earth and center electrodes.

Therefore the inventors have adopted in their factory, which is not open to the public, a masking member or masking paint for the earth electrode of the spark plug housing, thereby giving no plating to the earth electrode. However, it took a lot of time, long and complicated processes and much work force.

SUMMARY OF THE INVENTION

A principal object of the present invention is to provide a method for plating an article at a high speed, allowing a portion of the article to remain nonplated.

Another object of the present invention is to provide a method where a portion of the article not to be plated is chucked by a chuck and the chuck is kept nondipped to an electrolyte, thus giving the plating to only the remaining part of the article. In this case the boundary between the plated and nonplated portions is maintained constant over a large number of articles by an air space made around the chuck, which determines the length of the nonplated portion and works to suppress waves on the surface of the electrolyte.

Another object of the present invention is to provide an apparatus which is capable of giving the plating only to a predetermined portion, and of conducting the plating at a high speed over a number of articles to be plated.

Another object of the present invention is to provide an apparatus having a chuck and a shield cover around the chuck, wherein the shield cover projects over an end of the chuck and the article is grasped by the chuck at a portion that needs no plating, thus the plating is accomplished only at the remaining portion of the article.

In the present invention, the electrolyte is circulated to give the article enough metallization at all times, the current density is chosen properly, a distance between the anode and cathode selected properly, the article is rotated at a proper rotational speed, and the electrodes are properly constructed for the best plating.

DETAILED DESCRIPTION OF PREFERRED EMBODIMENTS

Figure 1:
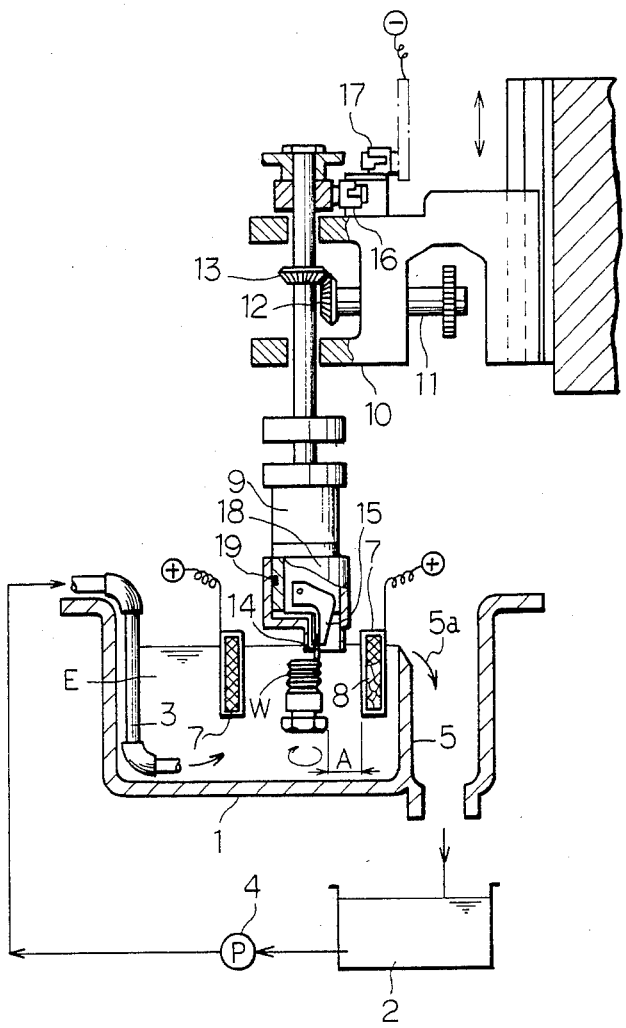
FIG. 1 is a partial cross-sectional view of the first embodiment of the present invention.

The present invention is explained based on the embodiments as shown in the drawings.

In FIG. 1, numeral 1 designates a station which holds an amount of electrolyte E therein. The electrolyte is supplied from a circulation pipe 3 via a pump 4 through many small holes formed in the pipe 3. The level of the electrolyte in the station 1 is controlled by an overflow wall 5 which overflows an excessive electrolyte out of it as indicated by an arrow 5*a* to maintain a constant level at all times. The overflown electrolyte returns to a circulation tank 2. Thus the effective components of plating, i.e. metallic ions necessary for high speed plating are timely and constantly supplied to the surfaces of the article W to be plated. In the station 1 are there provided a couple of soluble anodes to sandwitch the article. The anode may be of a circular shape. The anode is composed of a container 7 and anode metal 8 encased therein. The container 7 is preferably made from a mesh so that the metallic ions from the anode are easily dispersed. Further it is preferable to adopt the mesh anode container to attain an easy contact of the anode metal 8 with the electrolyte and to maintain an easy circulation of the electrolyte. As to the anode metal 8 a similar rule applies also, i.e. chip-shaped metal or ball-shaped metal is preferable for the shape of the anode metal 8.

To grasp and move the article to be plated, a chuck assembly 9 is utilized. The chuck assembly 9 holds and rotates a chuck 15 via a shaft 11 and bevel gears 12 and 13 as well as it works to supply a negative plating current to the article W via brushes 16 and 17. The article 9 is grasped by the chuck 15 at a portion where no plating is made, and the portion of the article W is kept always out of the electrolyte, thus plating only the desired part of the article W. In this embodiment the portion above referred to applies to an earth electrode 14 of a housing of a spark plug for internal combustion engines. Therefore the unplated earth electrode 14 is better used when the real electrode is made by bending the same to a center electrode which is assembled to the housing with an insulator.

A shield cover 18 is provided around the chuck 15, maintaining a space between the chuck 15 and the shield cover 18. There is also provided an O ring 19 to make the space airtight. The airtight space prevents the electrolyte from entering into the same. As shown in FIG.

6, when a certain cup is placed on the surface of the electrolyte to push it down, the volume V of the cup does not change much even if it is pushed pretty deeply, which is suggested in the Boyle.Charle rule indicated below. For example it is necessary to have 10.3 m as H to make the volume V half. Actually there is no substantial difference in the level of the electrolyte in the shield cover 18 in comparison with the outer electrolyte, since the H is about 2–10 mm in the present invention.

$$PV=P'V'$$

Wherein

P: Pressure needed when a cup is placed on the surface of the electrolyte,

V: Volume of the cup in the condition above,

P': Fluid pressure exerted when the cup is pushed down into the electrolyte to the depth H, and V': Volume of the cup in the condition above.

Figure 2:
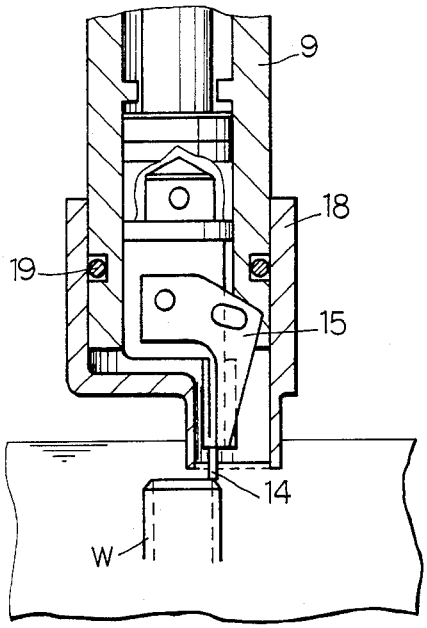
FIG. 2 is a partial cross-sectional view of a chuck assembly of the embodiment shown in FIG. 1.

In addition to the above, the shield cover 18 works to suppress waves on the electrolyte surface in the space between the chuck 15 and the cover 18 even if the surface of the outside electrolyte is waving. Therefore the earth electrode of the spark plug housing is always stably kept nonplated. The chuck 15 in the present invention is also above the surface of the electrolyte, therefore there is no need to scrape off the deposited metal on the chuck 15. FIG. 2 shows an enlarged view of the chuck assembly 9 of the present invention.

Various technological conditions on the present invention are explained below. It is preferable to make the distance A between the article W and the anode 6 or 7 as short as possible to lower the voltage needed. However if the distance A is made less than 10 mm, the end portion of the article W is plated thicker, which causes in the later step cracks. Further since the plating current is centralized at the end portion, it produces poor plating on the inner surface of the article. When the article has a threaded portion, the same thing applies, i.e. ridges are plated thicker, while the valley portions are plated thinner. On the other hand, when the distance A exceeds 40 mm, the thickness of the plating is made constant throughout the article, however it causes an increase in the required voltage, thus causing energy loss.

It is effective to rotate the article as suggested in a formula below to decrease the thickness of the diffusion layer around the article, however if it is below 20 rpm, it is likely that burning and scorching occur when the current density is high.

$$i_l=ZFDC_o/\delta_N$$

Wherein $i_l$: Limit current density,

D: Diffusion constant of ion determinative of salt,

F: Faraday constant,

Z: Valence, $C_o$: Content of electrolyte, and $\delta_N$: Thickness of diffusion layer.

According to the explanation above, it may be considered that any higher rotational speed of the article is acceptable, however it must be below 200 rpm, since with the higher speed the grasped portion is moved or the article itself drops because of the relatively small earth electrode in comparison with the whole spark plug housing.

The amount of circulation of the electrolyte also varies the degree of the diffusion thickness around the article. When the circulation amount is less than 2 liters/minute, it gives no effect to the decrease of the diffusion layer, and when the article is plated with a high current density, burning and scorching are apt to occur. Moreover it degradates the uniform plating around the article. On the contrary however, when the circulation amount is over 20 liters/minute, it causes uncontrollable rise of the electrolyte surface, or causes waves to occur on the surface of the electrolyte.

EXAMPLE 1

A spark plug housing is chucked as shown in FIG. 1 to conduct high speed partial plating.

The current density at the cathode is 30 A/dm$^2$, the distance A is 15 mm, the circulation amount of electrolyte is 8 liters/minute, and the rotational speed of the article is 100 rpm. Under these conditions the article was put to Ni plating for one minute. The resultant had uniform and glittering plated surface around the article, and it also had a good inner plating. The earth electrode which was out of the electrolyte was not plated.

This plating may be made after the spark plug housing has gone through the steps of from EXAMPLE 2 to EXAMPLE 4 below.

EXAMPLE 2

The spark plug housing is chucked by the chuck assembly likewise to apply high speed electrolytic cleaning.

The article is put on anode side, and the current density at anode is 30 A/dm$^2$, the distance A is 15 mm, the circulation amount of the electrolyte is 8 liters/minute, the rotational speed of the article is 100 rpm, and the material of the opposite pole is stainless steel.

The result shows that the plated surface is cleaned well, thus there occured no peel-off of the plating when examined after having applied Ni plating at a later step. The earth electrode on the other hand was not corroded by the mist generated during the electrolytic cleaning.

EXAMPLE 3

The article chucked likewise was applied to water cleaning step, which can be either after the electrolytic cleaning or Ni plating.

The result showed that the whole article was cleaned well, thus improved the efficiency of water cleaning. The electrolyte on the article may be blown off by air injection after the water cleaning, which contributes to prevent the loss of the electrolyte from the system.

EXAMPLE 4

The article was put in an acid cleaning process using aqueous solution of sulfuric acid after the water cleaning step.

The article was put in a bath holding 100 cc/liter of 98% $H_2SO_4$ at room temperature. The circulation amount of the cleaning liquid is 8 liters/minute, and the rotational speed of the article is 100 rpm.

The result shows that only the portions that need plating are acid-cleaned to make the surface active. therefore there occured no peel-off when examined after having applied Ni plating at the next step.

Figure 3:
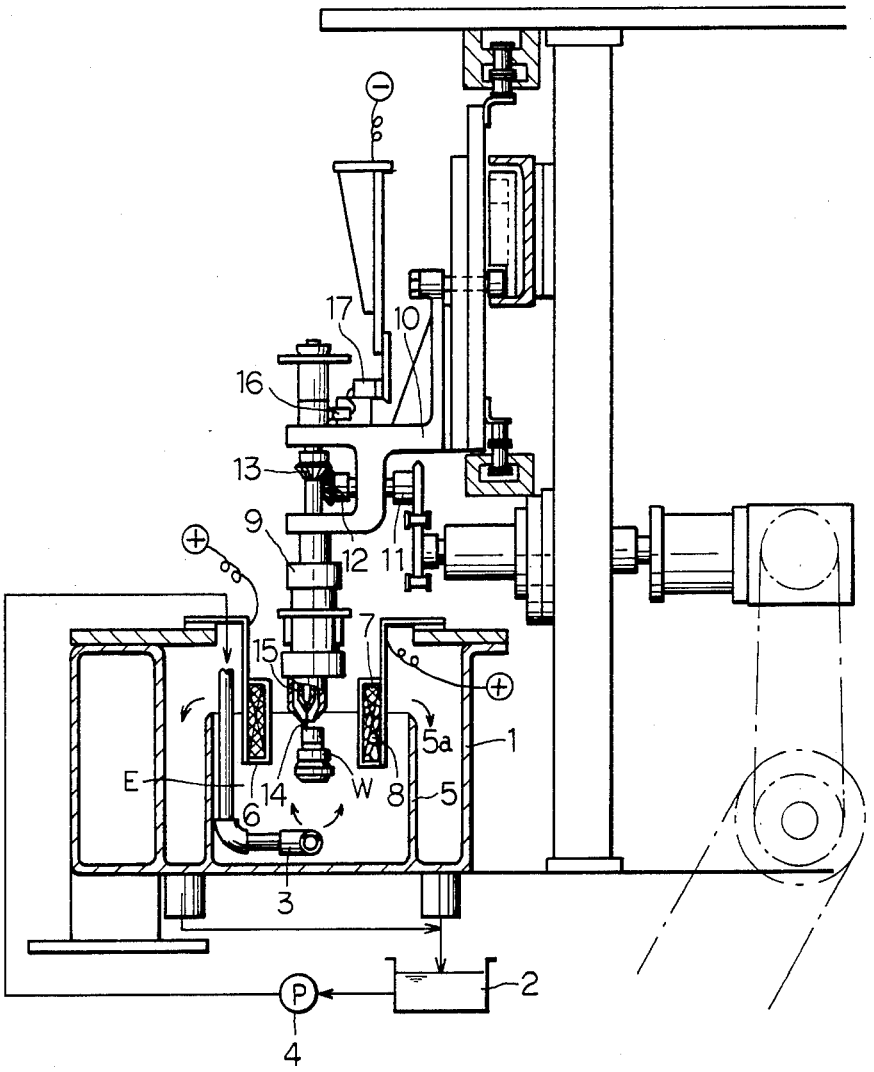
FIG. 3 is a partial cross-sectional view of the second embodiment of the present invention.
Figure 4:
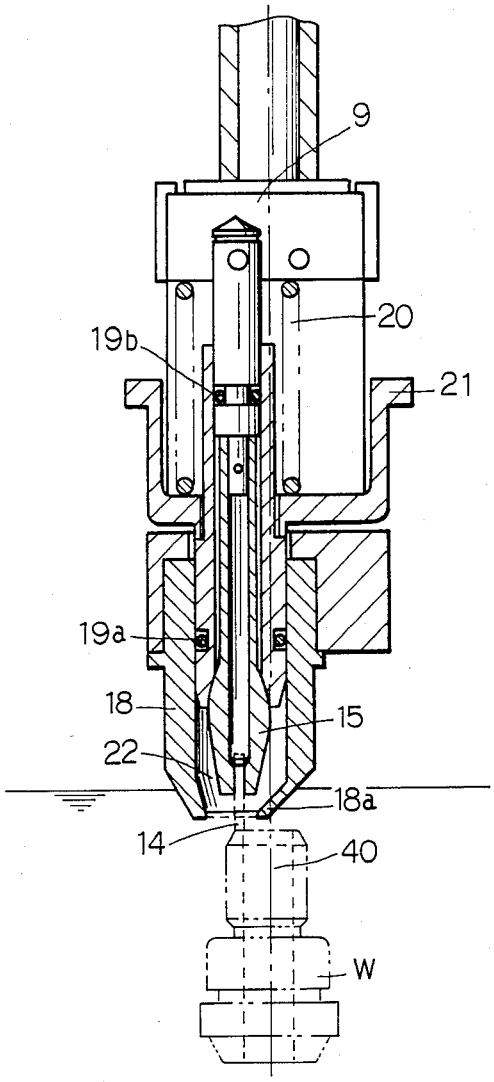
FIG. 4 is a partial cross-sectional view of a chuck assembly of the embodiment shown in FIG. 3.
Figure 5:
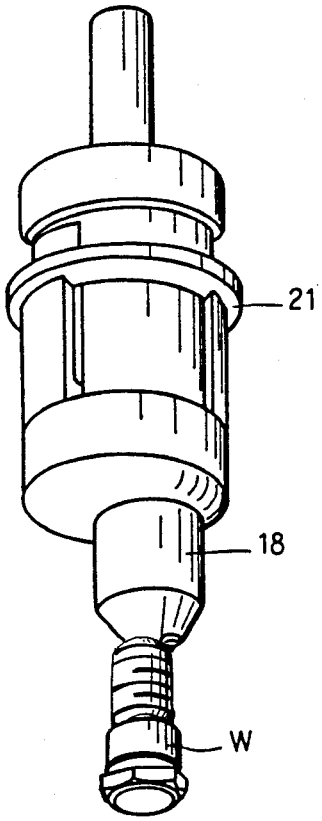
FIG. 5 is a perspective view of the chuck assembly shown in FIG. 4 and the article chucked by the same.

Another embodiment of the present invention is explained in accord with FIGS. 3, 4 and 5. FIG. 3 shows an arrangement of the apparatus, where it adopts another type of chuck at the numeral 15. It also shows more detailed construction of the arrangement around the moving arm 10. Other components are almost the same as in FIG. 1 as indicated with the same numerals. From this drawing it is clear that the arm 10 is movable vertically and in the direction of from the front surface of the paper to the rear surface or vice versa. The arm 10 allows the article to move up and down and horizontally so that the article is dipped into the electrolyte and any other liquid placed in succession.

As evident, since the portion of nonplating is determined by the position of the chuck and position of the article to be chucked, it is possible to plate other parts than the spark plug housing likewise by adjusting the above positions.

The chuck assembly 9 is illustrated in detail in FIG. 4. The collet chuck 15 is normally closed by a lever 21 biased downwardly by a coil spring 20. When the lever 21 is pushed upwardly, the collet chuck 15 opens to allow an insertion of a portion which requires no plating into the chuck 15, and then by removing the force the lever 21 moves downwardly to close the chuck 15. The coil spring 20 functions to hold the article during the movement thereof.

The space 22 between the collet chuck 15 and the shield cover 18 is maintained airtight by O rings 19*a* and 19*b*. The end portion of the shield cover 18 is inwardly tapered as shown in the drawing, and it is to be dipped a distance of about 2–10 mm. In this case, the end of the chuck 15 does not contact the surface of the electrolyte. An end 18*a* of the shield cover 18 is designed to be located in such a place that the end 18*a* faces a through hole 40 of the article W. This arrangement helps the through hole 40 have better plating on its surfaces. Moreover the article W is rotated around its own center axis so that there remains an equal distance to the opposing electrode at all times. FIG. 5 shows the chuck assembly 9 and the article chucked by the same.

As evident, since the portion of nonplating is determined by the position of the chuck and position of the article to be chucked, it is possible to plate other parts than the spark plug housing likewise by adjusting the above positions.

Figure 7:
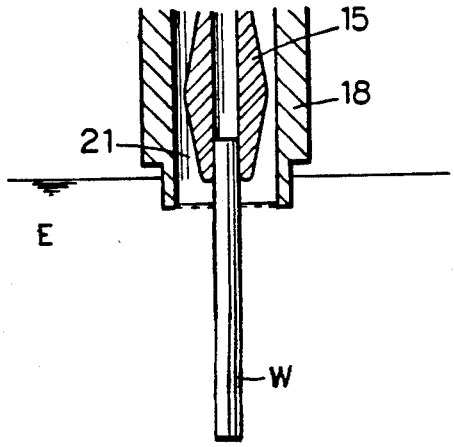
FIG. 7 is a partial cross-sectional view of the chuck assembly of the embodiment in FIG. 3 and another article chucked by the same.

In FIG. 7, a shaft chucked by the collet chuck 15 is illustrated. In this case the shaft is 40 mm long and the diameter is 3 mm, and the portion except the upper 5 mm is to be plated with Ni to a thickness of about 10 microns.

EXAMPLE 5

Under the following conditions, the above shaft in FIG. 7 was plated. The current density at cathode is 10 A/dm$^2$, the distance A is 20 mm, the circulation amount of electrolyte is 8 liters/minute and the rotational speed of the article is 50 rpm. The Ni plating was applied for 5 minutes.

The result showed that the upper 5 mm remained nonplated and the remainder was plated with a clear boundary made by the surface of the electrolyte. The plated surface was clear and glittering, and the nonplated portion was not corroded by the mist and the like.

Figure 6:
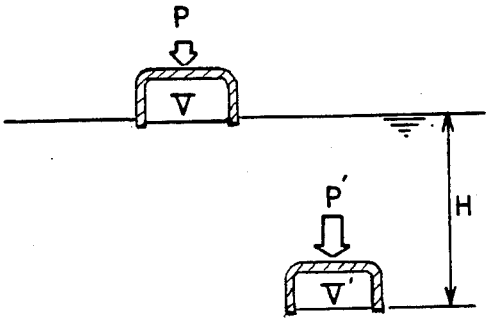
FIG. 6 is a drawing showing the principle of the present invention.

As described above, the present invention enables to plate only a desired portion of an article to be plated, deliniating a portion that needs no plating or is difficult to plate. To accomplish this, the present invention firstly utilized the principle as shown in FIG. 6, i.e. firstly recognized the applicability of the principle to the field of plating. The space between the chuck 15 and the shield cover 18 works well to push and maintain the level of the electrolyte in the shield cover 18 substantially constant regardless of the stable or wavy surface of the electrolyte throughout a number of articles to be applied. Thus the method and the apparatus of the present invention are useful for high speed partial plating of a large number of articles.

What we claim is:

1. A method for plating an article comprising the steps of preparing a station holding an amount of an electrolyte of a certain fixed level with an anode soaked in said electrolyte, grasping said article by a chuck at a portion of said article where no plating is needed within a shield cover, maintaining an airtight space between said chuck and said shield cover, and leaving a gap between an end of said chuck and an end of said shield cover, said article being cathode, and dipping said article together with said shield cover to such an extent that an end portion of said shield cover is dipped into said electrolyte, said end of said chuck being apart from a surface of said electrolyte, wherein said portion of said article is not plated, whereas all the remaining portion of said article is plated.

2. A method for plating an article as claimed in claim 1 further comprising the step of horizontally rotating said article in said electrolyte about an axis.

3. A method for plating an article as claimed in claim 2 further comprising the step of circulating said electrolyte through said station.

4. An apparatus for plating an article comprising:

a station for holding an amount of an electrolyte, means for leveling said electrolyte in said station, means for circulating said electrolyte through said station, a chuck supported in said apparatus for grasping said article at a portion of said article where no plating is needed, said chuck being rotatable about an axis, and also vertically movable to allow said article to be dipped partially into said electrolyte, said chuck being a cathode, a shield cover fixed around said chuck to maintain a space between said chuck and said shield cover, and end of said shield cover extending to a certain distance over said end of said chuck, so that an end of said chuck does not touch said electrolyte when said shield cover is partially dipped into said electrolyte, thereby plating all but said portion of said article.

5. An apparatus for plating an article as claimed in claim 4 further comprising an O ring placed between said shield cover and said chuck to make said space airtight.

* * * * *